US006748354B1

(12) United States Patent
King

(10) Patent No.: US 6,748,354 B1
(45) Date of Patent: Jun. 8, 2004

(54) WAVEFORM CODING METHOD

(75) Inventor: Reginald Alfred King, Shrivenham (GB)

(73) Assignee: Domain Dynamics Limited, Northampton (GB)

( * ) Notice: Subject to any disclaimer, the term of this patent is extended or adjusted under 35 U.S.C. 154(b) by 0 days.

(21) Appl. No.: 09/762,292

(22) PCT Filed: Aug. 11, 1999

(86) PCT No.: PCT/GB99/02647

§ 371 (c)(1),
(2), (4) Date: Apr. 6, 2001

(87) PCT Pub. No.: WO00/10161

PCT Pub. Date: Feb. 24, 2000

(30) Foreign Application Priority Data

Aug. 12, 1998 (GB) ..... 9817500

(51) Int. Cl.[7] ..... G10L 19/00

(52) U.S. Cl. ..... 704/202; 704/200.1; 704/201; 704/270

(58) Field of Search ..... 704/201, 202, 704/232, 270, 200.1

(56) References Cited

U.S. PATENT DOCUMENTS 5,117,287 A 5/1992 Koike et al. ..... 358/133
5,519,805 A 5/1996 King ..... 704/202
6,101,462 A * 8/2000 King ..... 704/202
6,175,818 B1 * 1/2001 King ..... 704/232
6,301,562 B1 * 10/2001 Azima et al. ..... 704/257

FOREIGN PATENT DOCUMENTS

| | | |
|---|---|---|
| EP | 0 141 497 | 5/1985 |
| EP | 0 166 607 | 1/1986 |
| WO | 97/45831 | 12/1997 |

OTHER PUBLICATIONS

"Time domain analysis yields powerful voice recognition", King, New Electronics, International Thomson Publishing, vol. 27, No. 3, Mar. 1994, pp. 12–14.

Predictive fractal inerpolation mapping: differential speech coding a low bit rates:, Wang, ICASSP '96, vol. 1, May 7–10, 1996, pp. 251–254.

"Low Rate Speech Encoding: New Algorithms and Results", T.C. Phipps et al., The First International Symposium on Communication Theory and Applications, Crieff(K), Sep. 1991.

* cited by examiner

*Primary Examiner*—Susan McFadden
(74) *Attorney, Agent, or Firm*—Jacobson Holman PLLC

(57) ABSTRACT

A signal processing system comprising coding means operable on an applied input signal for affording a plurality of successive waveform shape descriptors indicative of the applied signal and for comparing successive pairs of corresponding shape descriptors to afford a succession of outputs indicative of the differences thereof and characteristic of the applied signal.

12 Claims, 8 Drawing Sheets

FIG. 6

Table 1

| E1 | E2 | E3 | E4 | E5 | E6 | E7 | E8 |
|---|---|---|---|---|---|---|---|
| D1=13 | D2=17 | D3=17 | D4=24 | D5=6 | D6=24 | D7=32 | D8=6 |
| S1=0 | S2=0 | S3=0 | S4=1 | S5=0 | S6=1 | S7=1 | S8=0 |
| A1=23 | A2=14 | A3=31 | A4=32 | A5=10 | A6=17 | A7=30 | A8=24 |

Table 2

| E2/E1 | E3/E2 | E4/E3 | E5/E4 | E6/E5 | E7/E6 | E8/E7 |
|---|---|---|---|---|---|---|
| D1=+ | D2=0 | D3=+ | D4=− | D5=+ | D6=+ | D7=− |
| S1=0 | S2=0 | S3=+ | S4=− | S5=+ | S6=0 | S7=− |
| A1=− | A2=+ | A3=+ | A4=− | A5=+ | A6=+ | A7=− |

Table 3

| | | | | | | |
|---|---|---|---|---|---|---|
| 6 | 13 | 1 | 27 | 1 | 4 | 27 |

WAVEFORM CODING METHOD

FIELD OF THE INVENTION

This invention relates to signal processing arrangements and more specifically to such arrangements comprising coding means for affording a plurality of successive waveform shape descriptors indicative of said signal.

The invention is especially applicable to Time Encoding and Time Encoded Signal Processing and Recognition (TESPAR) as described in the prior art publications and existing patent documentation but is also applicable to other systems using waveform shape descriptors as the basis for signal comparison and classification.

BACKGROUND OF THE INVENTION

One of the major problems facing the designers of signal processing and signal classification systems for incorporation in, for example, a) word recognition equipment, and in particular speaker independent word recognition systems;

b) condition monitoring equipment, and especially,
   (1) Equipment for monitoring rotating machinery,
   (2) Equipment for monitoring the flow of substances through mechanical traps and pipes,
   (3) Machinery involved in the crushing of ore; and c) Perimeter intrusion monitoring equipment and systems is that the frequency spectra of the waveforms under examination may shift, in some cases dramatically, due to factors outside the control of the agencies deploying the monitoring equipment.

Thus, for example, in the word recognition task the pitch or frequency spectra of the spoken output of an individual speaker, who is addressing the system, may vary significantly. Rising, for instance, due to excitement or stress, or the effects of external background noise and lowering, for example, due to tiredness or physical fatigue.

In the case of the condition monitoring of rotating machinery, the acoustic vibration output recorded from a machine via a transducer, will, when the machine is rotating quickly, have a different (higher) pitch and frequency spectrum when compared with the spectrum of the identical machine when rotating slowly. Similarly, when monitoring the flow of material through pipes, the natural resonance of the pipes may change according to temperature or atmospheric pressure variations. Such temperature variations when monitoring the vibration of bridges to identify the effects of modifications and mechanical changes to the bridge structure may be a significant adverse factor.

When monitoring machinery involved in the crushing of ore, it is observed that the vibrations derived from the crusher may be a function of ore size and mix. Large sized ore particles producing predominantly low frequency outputs with small size ore particles producing mainly high frequency outputs. These changes and frequency shifts associated with ore size and mix are well known by those skilled in the art.

All the above variations and frequency shifts may be corrected to some extent by means of complicated and relatively inefficient frequency or time "normalisation" procedures whereby, for example, by means of separate additional and parallel procedures, some form of correction factor is estimated and applied to the measurements obtained. In the case of voice recognition, a measure of voice pitch, may be derived from parts of the input waveform and the whole of the input may then be standardised via a normalisation routine, to provide more stable and consistent inputs to the subsequent word recognition circuitry.

When monitoring rotating machinery, rotational speed may be estimated by secondary means such as "tachometer" hardware together with supplementary circuits, to provide a pulse or set of pulses derived from a rotating shaft to enable an indication of approximate speed of rotation to be calculated. From this, a normalisation or standardisation factor or factors may be applied so that a corrected output waveform may be computed.

Similarly temperature may be measured or estimated and normalisation calculated to correct for the adverse effects of temperature changes.

In ore crushing machinery, estimates may be made of the size of the ore by some separate supplementary physical measurement means and normalisation procedures invoked to enable common comparisons to be made over the variability in ore size and mix commonly encountered.

When monitoring underground seismic and or geophonic sensors for example, the output frequency response may change and shift significantly in "pitch", due to changing soil conditions associated with changes in climatic conditions. Such changes often preclude effective operation in many areas of interest, unless "normalisation" proves economical. In many instances such normalisation processes prove to be computationally intense and, if needed to be carried out in real-time or pseudo real-time they involve a requirement for very fast computer processing and very fast digital signal processing hardware and software. Such requirements with their associated complexity and cost often preclude successful commercial monitoring and classification activities in this and other similar application arenas.

Time Encoding and Time Encoded Signal Processing and Recognition (TESPAR) are well known, as described in EP 0 166 607, EP 0 141 497, U.S. Pat. No. 5,519,805 and WO 97/145831.

In its current prior-art form, the data sets produced by existing TESPAR processes to enable signal representations and classifications to be undertaken are substantially vulnerable to the changes in pitch and frequency previously described in this application. Thus, if an individual speaks in a high pitch voice, the standard 'S' matrix for example will contain a larger proportion of short epochs than a similar matrix derived from an input from a normally spoken utterance. Similarly, if the same person speaks the same word in a low pitch, the 'S' matrix will contain a larger proportion of symbols associated with longer epochs. Thus standard prior-art TESPAR alphabets and data sets when applied to these frequency shifted signals may also need to have some precursor normalisation processing applied to them, to enable consistent and accurate classification to take place. This may be achieved by many different methods. Uniquely with TESPAR, for example, by the use of Artificial Neural Networks (ANNs), whereby the training material which varies in pitch, as described, may be applied to an ANN after TESPAR coding. Given the fixed TESPAR matrix size and dimensions, in many cases of interest, the network will identify discriminants derived from this input data to provide a characterisation which may be substantially invariant to changes in pitch. This is a complicated normalisation option and the outcome cannot always be guaranteed. A wide range of these and other normalisation procedures are deployed throughout the signal processing community, which accepts the necessity for this additional complexity and equipment and cost to enable relatively stable comparisons and classifications to be made, providing such normalisation is commercially cost effective.

It has been discovered that waveforms subject to pitch variations and frequency variations (associated with speed of rotation, temperature changes, variable ore size, etc), may be advantageously processed by means of a new highly optimised TESPAR coding process, which is substantially invariant to the changes described above, thus eliminating the need for additional complicated and costly "normalisation" procedures.

This advantageous so called "DZ" coding of the TESPAR symbol stream obviates the need to carry out time normalisation, and or frequency normalisation and, DZ coding exhibits properties which enable classifications to be made which are relatively invariant to "sample rate" changes, thus obviating the need, given a particular Analog to Digital (A to D) converter, to carry out interpolation or decimation on the digital signal representations of the original waveform.

Thus the new TESPAR coding method which is substantially invariant to changes in pitch, engine speed, ore size etc. removes the requirement to normalise the waveform under examination, dynamically, or in non-real time, via separate tachometer or other complex computational procedures.

In accordance with the present invention there is provided a signal processing arrangement comprising coding means operable on an applied input signal for affording a plurality of successive waveform shape descriptors indicative of said signal and for comparing successive pairs of corresponding shape descriptors to afford a succession of outputs indicative of the differences thereof and characteristic of said signal.

In a preferred arrangement for carrying out the invention it is arranged that the said coding means is a TESPAR coder, and in which said successive waveform shape descriptors correspond to duration, shape and amplitude symbols corresponding to successive epochs of said input signal.

It may be arranged that successive symbols which are immediately adjacent are compared, or alternatively it may be arranged that successive symbols which are separated by a predetermined number of symbols are compared.

BRIEF DESCRIPTION OF THE DRAWINGS

FIG. 6 depicts three tables, Table 1, Table 2 and Table 3 relevant to the present invention.

BRIEF DESCRIPTION OF A PREFERRED EMBODIMENT

Figure 1:
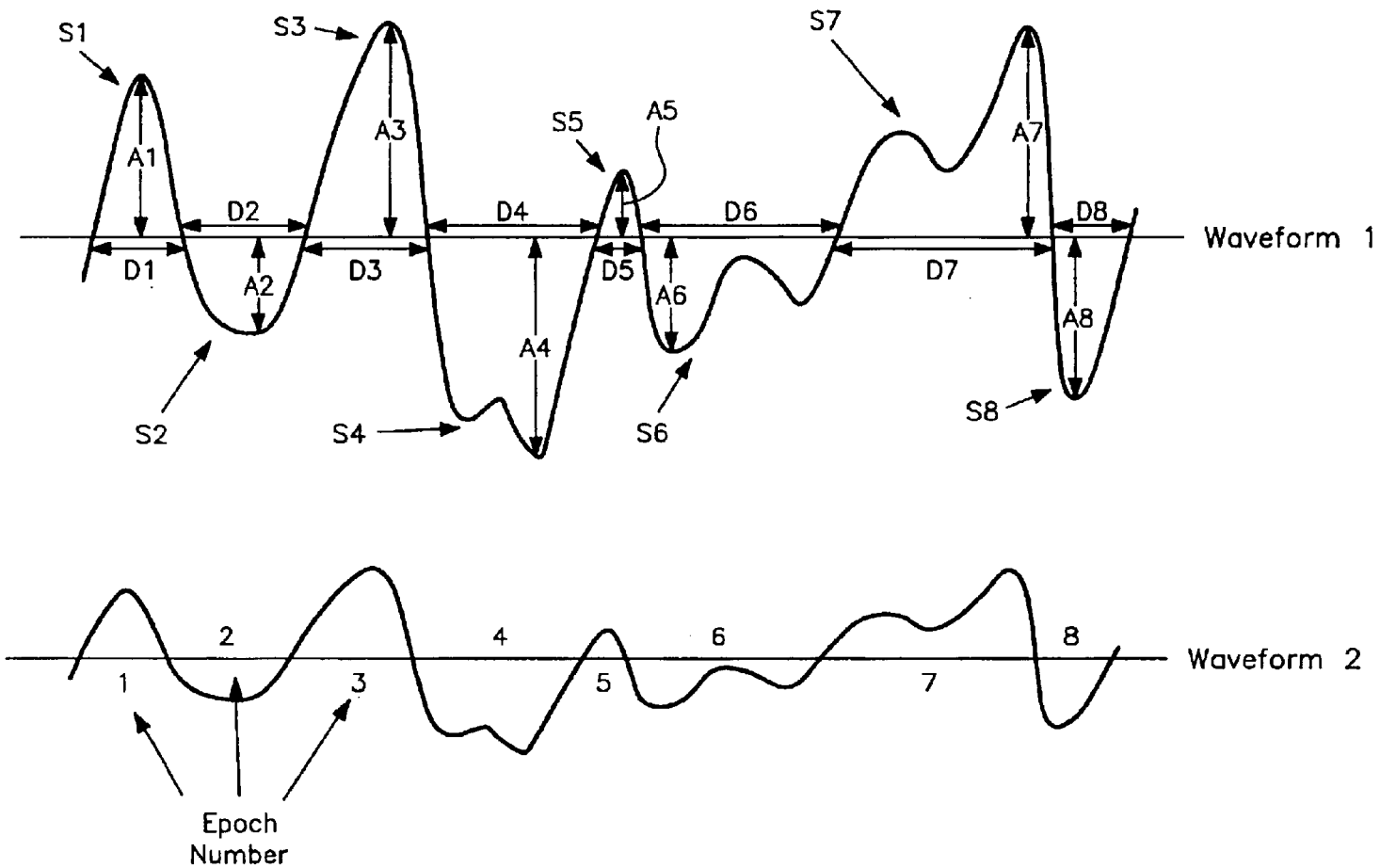
FIG. 1 depicts Waveform 1 and Waveform 2, which illustrate first order magnitude invariance.

Examples of typical Waveforms are depicted in FIG. 1, identified as Waveform 1 and as Waveform 2. Waveform 1 and Waveform 2, which are identical except that, the amplitude of Waveform 1 is greater than that of Waveform 2.

Given Waveform 1 and referring to Reference 1 et seq, it will be apparent to those skilled at the art that a standard TESPAR coder, as defined in Reference 1, would examine each "epoch", that is to say the time interval between the real zeros of the waveform, and for each such epoch create a code in the form of waveform shape descriptors related to duration "D", shape "S" and amplitude "A" of the waveform in between. That is to say the duration between the real zeros, the shape descriptor based upon, for example, the number of positive minima or negative maxima in the epoch and peak amplitude value of the epoch.

An examination of Waveform 2 indicates a waveform where the "D" and "S" values of Waveform 2 are identical to those of Waveform 1. It will be observed however, that the magnitude or amplitude "A" values have been reduced. The standard TESPAR coding procedures described in the literature could be vulnerable to such amplitude chances.

Figure 2:
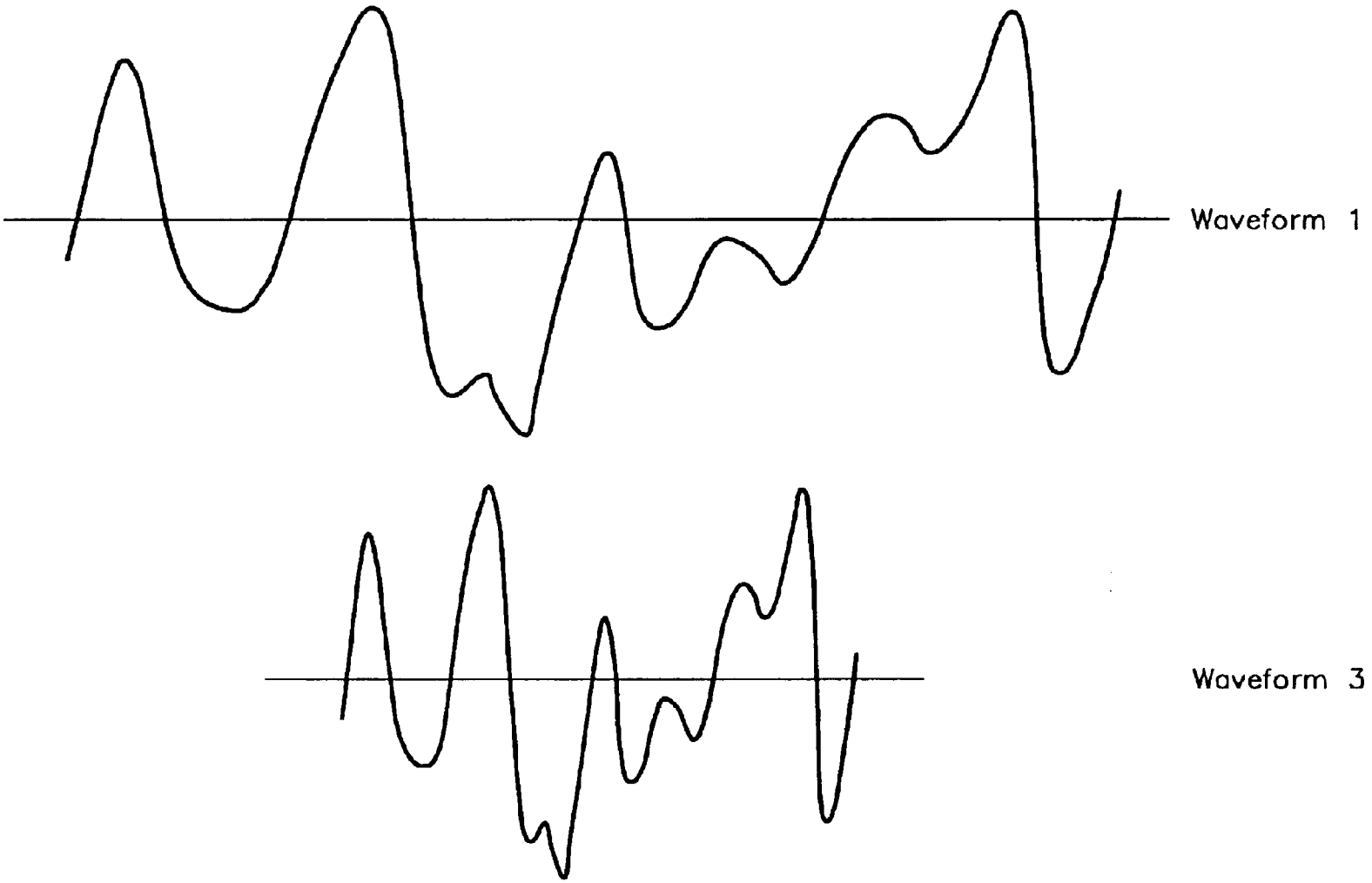
FIG. 2 depicts Waveform 1 and Waveform 3, which illustrate first order speech/pitch invariance.

In FIG. 2, Waveform 1 is repeated and a "Waveform 3" produced which represents a frequency or pitch shift of ×2 (times two), that is to say all the frequency components in the first waveform have been doubled (shifted up) to produce the second waveform. From this it will be seen that the durations, ie, the "D" values of each epoch, that is to say the time intervals between the real zeros of the waveform have been halved. The amplitudes "A" remain the same and the shape descriptors "S" in each epoch remain the same.

If a standard TESPAR 'S' or 'A' matrix were to be produced from these two waveforms it would be apparent to those skilled in the art that the pre-disclosure, prior-art TESPAR symbols derived from Waveform 3 would be quite differently distributed in a TESPAR matrix from those of Waveform 1.

Figure 3:
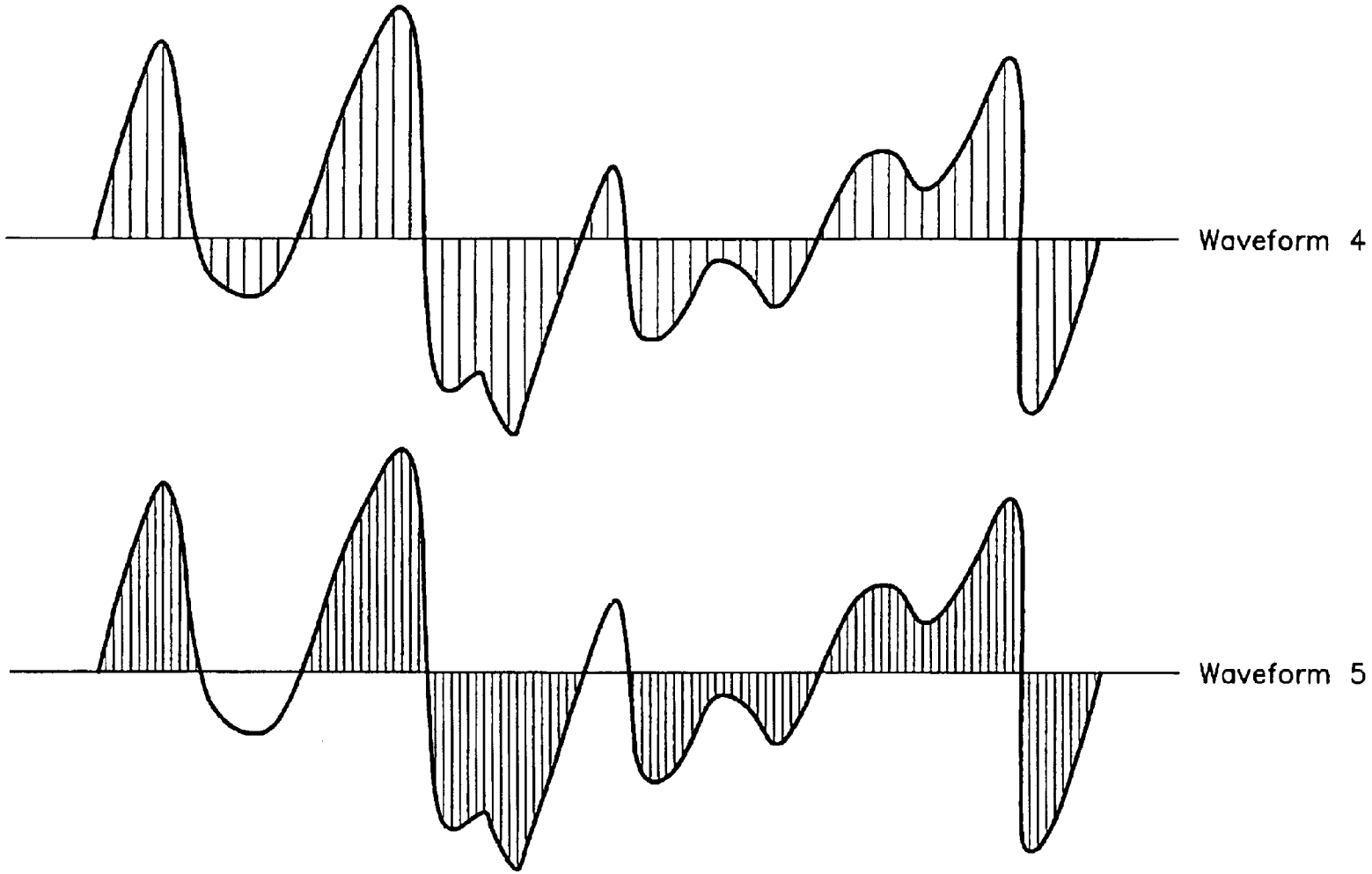
FIG. 3 depicts Waveform 4 and Waveform 5, which illustrate first order sample rate invariance.

Finally, in FIG. 3, two waveforms, Waveform 4 and Waveform 5 are shown which are identical and correspond essentially to Waveform 1 of FIGS. 1 and 2. An examination of Waveform 4 indicates Waveform 1 sampled at a particular sample rate from which may be derived the durations of the epoch in terms of the number of samples between the real zeros. An examination of Waveform 5 indicates an identity of waveform between Waveforms 5 and 4. However it is noted that Waveform 5 is sampled at a much higher rate than Waveform 4. For simple conventional TESPAR coding therefore the numerical values assigned to the epoch of Waveform 5 would be considerably larger by a given factor when compared to those of Waveform 4, thus, it will be obvious to those skilled in the art, that with simple prior-art TESPAR coding, the TESPAR matrix symbols generated from Waveform 5 would be associated with larger numbers and hence indicate longer time intervals than those of Waveform 4.

It has now been discovered that all such waveforms may advantageously be processed to generate a consistent and common representative TESPAR coding symbol stream which is substantially invariant to the changes and variations described above that is to say changes in pitch, speed of rotation, sampling rate, etc.

Figure 8:
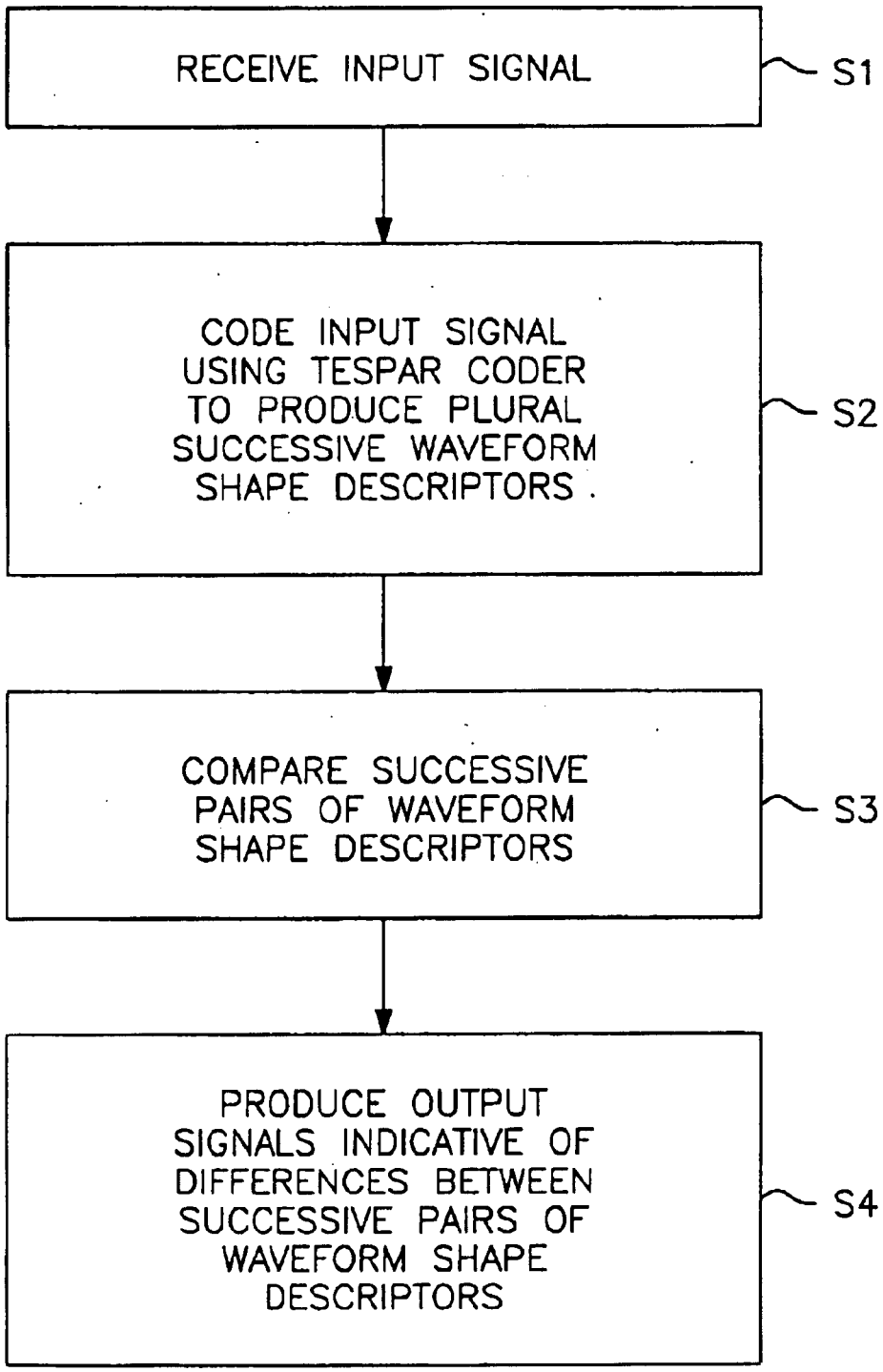
FIG. 8 is a process flow diagram of a method of signal processing.

The new disclosure involves examining successive pairs of natural prior-art TESPAR waveform shape descriptors or alphabet symbols, and calculating a set of coded data, by means of comparing the numerical differences between the successive "D", "S", & "A" pairs. A process flow diagram of the signal processing method is shown in FIG. 8. This comparison procedure simply records the difference, between successive symbol pairs in terms of their Duration, their Shape and their Amplitude vectors. Given that successive epochs may be described in terms of duration, shape and amplitude, that is to say "D" "S" & "A", sets of differential (now called "DZ") descriptors may be formed as indicated in this and the paragraphs below. Previous literature, describes that Symbol 1 may be represented in prior-art TESPAR coding as D1, S1, A1. Symbol 2, as D2, S2, A2. Symbol 3, as D3, S3, A3 etc. to the end of the sequence, eg, DN, SN, AN.

By means of the DZ coding procedure, comparisons may be made between pairs of epochs, whereby the individual features Duration, Shape and Amplitude from each pair are compared and a differential vector produced for each epoch, indicative of the differences between the individual D, S, and A, features of the two epochs being compared.

It has been discovered that, advantageously, this may be done for different lags. Thus, for example and for illustration, a lag of 1 is first shown below. Epochs are compared successively with a specified lag. For example, with a lag of 1, comparisons will be made between epoch 2 versus epoch 1, epoch 3 versus epoch 2 epoch 4 versus epoch 3,

. . . , epoch N versus epoch N−1,

For a lag of 2, comparisons will be made between epoch 3 versus epoch 1, epoch 4 versus epoch 2, epoch 5 versus epoch 3,

. . . , epoch N versus epoch N−2 and so on . . .

In the simplest of "DZ" codes, for example, for each individual paired comparison a three-stage comparison vector may be generated for each epoch feature. Thus for a lag of 1, when comparing "D", "S", "A", for epochs 1 & 2 successively, the following comparison codes may result.

For "D2 versus D1"

If D2 equals D1, then DZD yields 0

That is to say, the DZ duration vector for the epoch pair "D" comparison is zero.

If D2 is less than D1 then DZD yields −1

That is to say, the DZ duration vector for the epoch pair "D" comparison is minus 1.

If D2 is greater than D1 then DZD yields +1

That is to say, the DZ. duration vector for the epoch pair "D" comparison is plus 1

When comparing, "S2 versus S1"

If S2 equals S1, then DZS yields 0

That is to say, the DZ duration vector for the epoch pair "S" comparison is zero.

If S2 is less than S1 then DZS yields −1

That is to say, the DZ duration vector for the epoch pair "S" comparison is minus 1.

If S2 is greater than S1 then DZS yields +1

That is to say, the DZ duration vector for the epoch pair "S" comparison is plus 1

When comparing, "A2 versus A1"

If A2 equals A1, then DZA yields 0

That is to say, the DZ duration vector for the epoch pair "A" comparison is zero.

If A2 is less than A1 then DZA yields −1

That is to say, the DZ duration vector for the epoch pair "A" comparison is minus 1.

If A2 is greater than A1 then DZA yields +1

That is to say, the DZ duration vector for the epoch pair "A" comparison is plus 1

Figure 4:
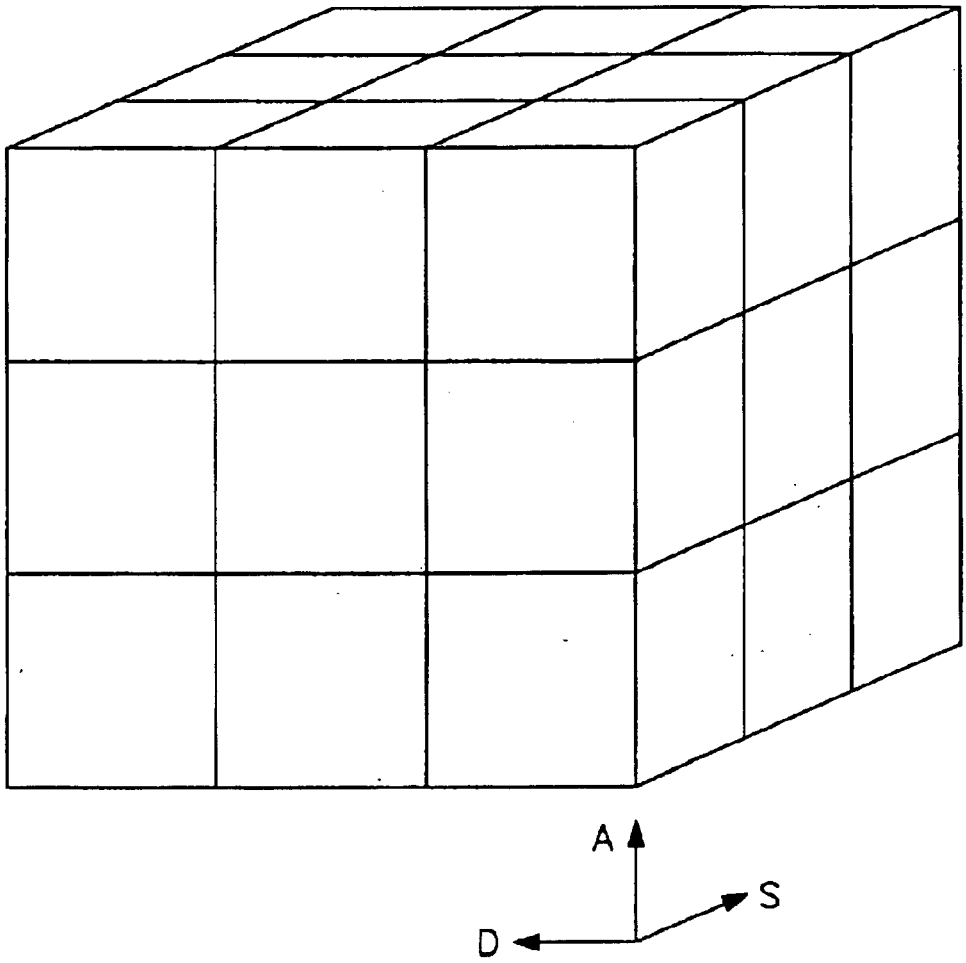
FIG. 4 is a diagram depicting first order "DZ" coding in "3" space.
Figure 5:
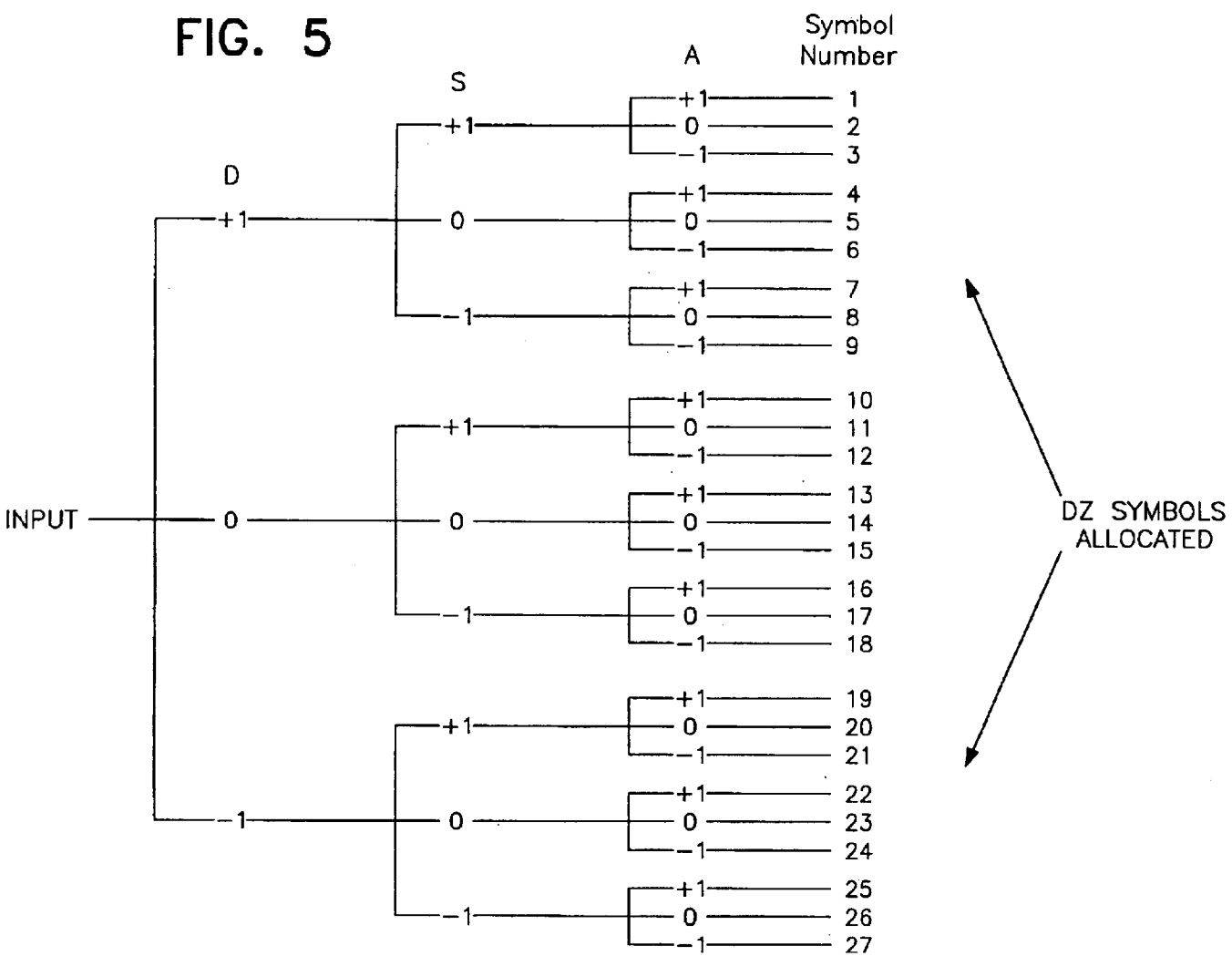
FIG. 5 depicts a first order "DZ" coding tree diagram.
Figure 7:
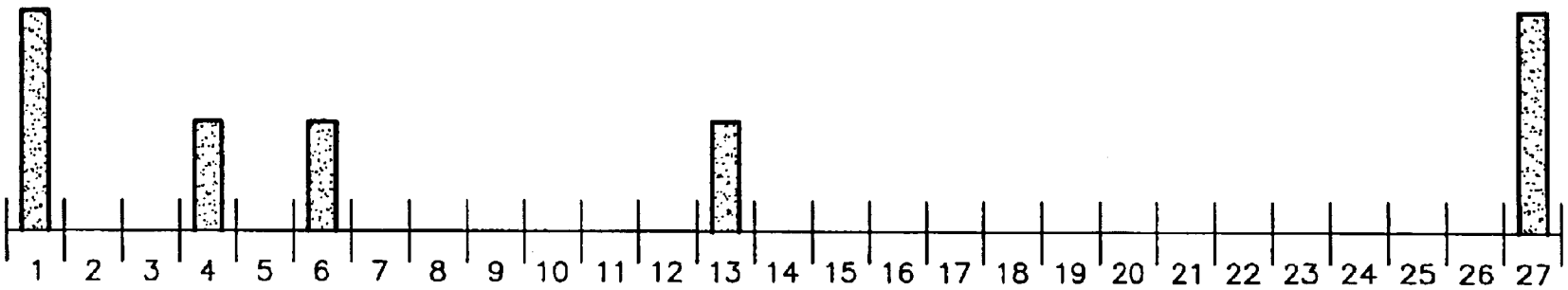
FIG. 7 depicts a "DZ" matrix derived from Table 1, 2 and 3 of FIG. 6 and the tree diagram of FIG. 5.

By these means, from any paired comparison of "D", "S", & "A", one of 27 possible difference options (viz. 3×3×3=27) may be derived, indicative of the nature of the difference between the pair of epochs under investigation. These may be arbitrarily but uniquely assigned to the elements, 1 to 27, of a 27 symbol DZ TESPAR Alphabet. Thus, as the comparisons are made consecutively throughout the symbol stream, a 27×1 Matrix may be accumulated indicative of the first order DZ symbol distribution associated with the waveform under investigation. The 3×3×3 nature of this DZ coding option may be illustrated by the "Three Space" coding diagram at FIG. 4 and also from the illustrative coding "Tree Diagram" in FIG. 5 which shows one example of DZ code assignment which exemplifies the new process.

For clarity, and by way of illustration, "D", "S", and "A" values associated with Waveform 1 are listed in Table 1 of FIG. 6, for each of the eight epochs of the exemplar Waveform 1 shown on FIG. 1. Their individual "D", "S", & "A" comparative "DZ." coding values are listed in Table 2 of FIG. 6. DZ coded Alphabet symbols derived from the illustrative tree structure shown at FIG. 1, five are assigned and listed in Table 3 of FIG. 6. From Table 3, an illustrative single dimension 27×1 DZ matrix may be calculated which is representative of the coding so far described. This is shown in FIG. 6.

From these examples it may be seen that, Waveforms 2, and 3, and 4, and 5 would produce DZ matrix distributions substantially identical to those of Waveform 1 that is to say, their DZ descriptor matrices would be invariant to the shifts and mutilations described.

It will be appreciated that such DZ matrices may be incorporated from compositions of epochs with lags other than 1, and that DZ coding may also be used to produce higher (ie 2 or 3 . . .) dimensional DZ matrix descriptors. For example, two dimensional matrices similar to 'A' matrices may be derived, where the difference vectors associated with, for example, Symbol 1 and Symbol 2 may be paired with, for example, the differences between successive symbols 3, and 4, and so on, in a manner similar to "A" matrix construction, to provide a 27×27 two dimensional matrix which is highly informative about the nature of the input waveform but equally substantially invariant to changes in magnitude, or pitch shifts or sample rate variations.

It will be appreciated that the example given involves absolute comparisons. For example, only if the magnitude of epoch 1 is identical to the magnitude of epoch 2 will the differential magnitude vector be zero. This may often prove to be an over precise comparison procedure. It has been discovered that the effectiveness of the DZ. procedures may be increased by introducing the concept of comparisons of similarity or difference, based on allowable thresholds. For example, if two amplitudes are being compared, a decision logic may be applied such that if A2=A1 to within (+ or −)× %, then A1=A2 yielding a zero difference vector. Similarly if A2 is × % greater than A1, the DZ procedure may yield +1, and if A2 is ×% less than A1, the DZ procedure may yield −1. It will be apparent to those normally skilled in the art, that such a thresholding strategy may introduce considerable robustness into the DZ data representation and provide protection against noise and random or transient variability occurring in the signal under investigation. It will also be appreciated that the thresholds applied to the "D" feature need not be the same as those applied to "S" or "A". Also that these thresholds may be applied dynamically.

It will also be appreciated that the dimensionality and hence the sensitivity of the DZ descriptors may be increased by admitting more than the three options previously described, as associated with each comparison of a single epoch pair. In the embodiments described so far, comparisons have admitted three options only, ie, "the same", "larger", or "smaller", without reference to any scale or measure of largeness or smallness by which the three principle TESPAR features differ. It has been discovered that for many applications more sensitive comparisons may be appropriate such that, to advantage, a comparison may yield more than one value descriptor. For example, given a "0" indicating "the same", a "−1" may indicate a given range of negative difference, and a "−2" for a larger range of negative difference than that indicated by a "−1". Similarly the positive difference vector may be extended to 2 or even more options. Such thresholds and expansions of the alphabet may be invoked, to provide more sensitively and to highlight different features of interest in the DZ matrices produced from the waveforms under comparison. These would of course result in larger DZ alphabet sizes and hence larger matrices.

Considerable research has indicated DZ TESPAR coding to be highly advantageous in the design of speaker independent word recognition systems in that the amount of training data required may be reduced significantly by some 2–3 orders of magnitude (100–1000). Similar reductions in complexity and computation power required to monitor rotating machinery such as railway axles and ore crushing machinery have been indicated.

It will be obvious to those skilled in the art that, in addition to the special properties described above, DZ matrices will, in addition, enjoy all the many ubiquitous advantages of prior-art TESPAR matrices described in the literature, viz. the ability to Archetype, to code time-varying waveforms for effective processing by Artificial Neural Networks (ANNs), to create massively parallel neural network architectures (MPNA) architectures, to perform Exclusion Matrices etc.

What is claimed is:

1. A signal processing system comprising coding means operable on an applied input signal for affording a plurality of successive waveform shape descriptors indicative of said signal and for comparing successive pairs of corresponding shape descriptors to afford a succession of outputs indicative of the differences thereof and characteristic of said signal and in which the said coding means is a TESPAR coder, and in which said successive waveform shape descriptors correspond to duration, shape and amplitude symbols corresponding to successive epochs of said input signal.

2. A system as claimed in claim 1, in which successive symbols which are separated by a predetermined number symbols are compared.

3. A system as claimed in claim 1, in which successive symbols, which are immediately adjacent, are compared.

4. Signal processing apparatus, including input means for receiving an input signal;

coding means for coding said input signal to produce a plurality of successive waveform shape descriptors indicative of said input signal; and comparing means for comparing successive pairs of corresponding shape descriptors to produce a succession of output signals indicative of differences between said successive pairs and thereby characteristic of said input signal wherein said coding means performs TESPAR coding and successive waveform shape descriptors correspond to duration, shape and amplitude symbols for successive time periods of said input signal.

5. Apparatus according to claim 4, wherein said comparing means compares successive symbols that are immediately adjacent.

6. Apparatus according to claim 4, wherein said comparing means is configured to compare successive symbols that are separated by a predetermined number of symbols.

7. A method of processing input signals, comprising the steps of coding input signals to produce a plurality of successive waveform shape descriptors indicative of said input signal; and comparing successive pairs of corresponding shape descriptors to produce a succession of output signals indicative of differences between said successive pairs thereby characteristic of said input signal wherein said step of coding input signals includes performing TESPAR coding, such that successive waveform shape descriptors correspond to duration, shape and amplitude symbols for successive time periods of said input signal.

8. A method according to claim 7, wherein said step of comparing successive pairs compares successive symbols that are immediately adjacent.

9. A method according to claim 7, wherein said step of comparing successive pairs compares successive symbols that are separated by a predetermined number of symbols.

10. A computer-readable medium having computer-readable instructions executable by a computer such that, when executing said instructions, a computer will perform the steps of processing input signals by coding input signals to produce a plurality of successive waveform shape descriptors indicative of said input signal; and comparing successive pairs of corresponding shape descriptors to produce a succession of output signals indicative of differences between said successive pairs thereby characteristic of said input signal, and such that when executing said instructions said step of coding input signals includes performing TESPAR coding, such that successive waveform shape descriptors correspond to duration, shape and amplitude symbols for successive time periods of said input signal.

11. A computer-readable medium having computer-readable instructions according to claim 10, such that when executing said instructions said step of comparing successive pairs compares successive symbols that are immediately adjacent.

12. A computer-readable medium having computer-readable instructions according to claim 10, such that when executing said step of comparing successive pairs, successive symbols are compared that are separated by a predetermined number of symbols.

* * * * *